US005213522A

United States Patent [19]

Kojima

[11] Patent Number: 5,213,522

[45] Date of Patent: May 25, 1993

[54] CONNECTOR WITH BUILT-IN FILTER

[75] Inventor: Yasushi Kojima, Niigata, Japan

[73] Assignee: Mitsubishi Materials Corporation, Tokyo, Japan

[21] Appl. No.: 912,789

[22] Filed: Jul. 13, 1992

[30] Foreign Application Priority Data

Jul. 19, 1991 [JP] Japan ..... 3-203224

[51] Int. Cl.[5] ..... H01R 13/66

[52] U.S. Cl. ..... 439/620; 333/185

[58] Field of Search ..... 439/620, 608; 333/181-185

[56] References Cited

U.S. PATENT DOCUMENTS 4,784,618 11/1988 Sakamoto et al. ..... 439/620

4,995,834 2/1991 Hasegawa ..... 439/620

*Primary Examiner*—Gary F. Paumen

*Attorney, Agent, or Firm*—McAulay Fisher Nissen Goldberg & Kiel

[57] ABSTRACT

In a connector with built-in filter having a dielectric housing with recesses at both ends and a partitioning plate positioned therebetween; connector pins penetrating through the partitioning plate into the second recess; and a conductive shield case having a window which corresponds to the second recess, the case having an edge at the window, the improvement comprising a ferrite body, inserted within the second recess, the ferrite body having slots corresponding to the connector pins and notches positioned between the slots and the window edge, the notches being contiguous with the slots; and chip capacitors inserted into the notches of the ferrite body, the capacitors being electrically connected between the edge of the shield case and the connector pins. The ferrite body may be unitary or a combination of ferrite portions.

7 Claims, 6 Drawing Sheets

CONNECTOR WITH BUILT-IN FILTER

BACKGROUND OF THE INVENTION

1. Field of the Invention

The present invention relates to connectors for coupling electronic devices. In particular, it relates to connectors having filters for suppressing noise generated from areas both internal and external to the electronic devices being connected.

2. Description of the Related Art

Digital apparatus utilizing semiconductor elements such as integrated circuits have noise-related problems which cause the apparatus to malfunction. The noises often travel through power lines or signal lines external to the apparatus or through antennas, using the aerial propagation path. In some cases, circuit elements within the digital apparatus are destroyed by such noises.

Conventional countermeasures generally taken for solving these noise-related problems include (1) making up a low-pass LC filter circuit by combining capacitors and inductors on printed circuit boards at every signal path within the devices or (2) mounting a low-pass filter which has been formed by combining the elements.

Publicly known capacitors and LC filters, however, have a large residual inductance with respect to circuit ground. Sometimes, as a consequence, it is impossible to satisfactorily eliminate high frequency noises due to the increased residual inductance caused by the wiring on the printed circuit board. To eliminate the increased inductance, therefore, ground terminals must be connected to a plurality of signal paths. Adding the ground terminals, however involves complex wiring designs of the printed circuit boards. Adding elements and wiring to the circuit boards, however, results in increased surface area and increased cost.

For radiated noises, the connector which couples the electronic devices acts as a bridge, allowing the noise to by-pass the noise filter mounted on the printed circuit board. In an effort to eliminate this problem, a connector has been used having an LC filter incorporated therein. Such connector is a shield structured connector which has a filter which uses built-in feed-through capacitors. This design provides for grounding the connector directly to the casing of the device, which is a stable grounded body. This arrangement, therefore, reduces the residual inductance generated at a ground-side of the filter compared with the case where the filter was mounted on the printed circuit board. A satisfactory noise reduction effect can be obtained by shielding the device electromagnetically.

As shown in FIG. 10, in the conventional connector with built-in filter having a feed-through capacitor incorporated therein, a connector pin 3 is fixed in a partitioning plate 2 of a dielectric housing 1, and penetrates therethrough. A conductive shield case 4 having a window 5 is fixed to the housing 1. A feed-through capacitor 6 is inserted onto the connector pin 3 and ring-shaped solders 7 and 8 are applied. The capacitor 6 is soldered to a window edge 5*a* of the shield case 4 and to the connector pin 3, respectively. A protruding end of the connector pin 3 is securely inserted into a ferrite core 9 for improving filter characteristics.

The conventional connector with built-in filter using a built-in chip capacitor (not shown) is constructed having a plurality of holes into which the connector pins are inserted. Each edge of the holes is formed having a conductor pattern and a common ground-side pattern. A capacitor is connected between the conductor patterns on the printed circuit board, and thereafter the conductor patterns are connected respectively to the connector pin and the shield case.

Such connectors with built-in filters having feed-through capacitors incorporated therein have the advantages described above but also have a number of problems. First, when the feed-through capacitor 6 is soldered to the window edge 5*a* of the shield case 4 and the connector pin 3, soldering flux seeps into the space between the partitioning plate 2 of the housing 1 and the soldering portion of the shield case 4. The residual flux may degrade the insulating characteristics of the feed-through capacitor 6, after a period of time.

Second, a difference between the thermal expansion coefficients of the shield case 4 and that of the housing 1 may result in stressing and cracking of the feed-through capacitor 6 depending upon ambient temperature variations Third, generally in the conventional example, to improve the filter characteristics, the connector pins are inserted into a plurality of ferrite beads or a ferrite core in which a plurality of through holes are formed. Since the ferrite beads and the ferrite core are provided on the outside of the shield case after the capacitors are soldered, it is difficult to miniaturize such connector. Furthermore, an additional process is required for positioning the ferrite core which results in increased costs.

Fourth, in the connector with built-in filter, it is desirable to make the spacing between the connector pins small to reduce the size of the connector. This is difficult, however, due to the limitations in (1) the mechanical strength of the feed-through capacitor and (2) limitations encountered in manufacturing.

Fifth, a connector with built-in filter which is capable of eliminating noise at a low-frequency band requires a capacitor having large capacitance. Small, mass-produced feed-through capacitors generally available in the market do not provide as large a capacitance as a unit capacitor. Although a feed-through capacitor of laminate type having a large capacitance is available, it has a substantially higher cost.

In a connector with built-in filter using a built-in chip capacitor, the increase in the number of the components used makes its construction complex. Moreover, since a printed circuit board is used, the residual inductance generated at the ground-side of the capacitor increases, and sometimes the noise at a high-frequency band cannot be eliminated. In order to form a complete electromagnetic shield, a dual-side mounting printed circuit board is required. The dual-side board has ground patterns formed on the entire bottom surface. This, however, results in increased cost.

Furthermore, in order to improve filter characteristics, a ferrite core with multiple holes or ferrite beads must be added after the connector is mounted. This raises its cost due to the increased number of process steps.

SUMMARY OF THE INVENTION

An object of the present invention is to provide a connector with built-in filter which eliminates insulation deterioration over time in the space between a connector pin and the shield case. In addition, the present invention provides an arrangement in which the capacitor will not be damaged due to thermal expansion.

Another object of the present invention is to provide a low-cost, compact connector with built-in filter having upgraded characteristics which demonstrates satisfactory electromagnetic shielding.

Still another object of the present invention is to provide a connector with built-in filter which reduces the residual inductance generated at the ground-side of the capacitor to an extremely small value, which results in satisfactory filter characteristics.

The connector with built-in filter of the present invention improves upon the known connectors with built-in filter having a dielectric housing, such housing having first and second ends, a first recess being formed at the first end and a second recess being formed at the second end, the first and second recesses having a partitioning plate therebetween; connector pins having first and second ends, the first end positioned within the first recess, the pins penetrating through holes provided within the partitioning plate, and the second end protruding through the second recess; a conductive shield case for surrounding the housing, the case having a window which corresponds to the second recess, the case having an edge at the window, the case being positioned so that the connector pins can protrude from the window.

The improvement comprises:

(a) a ferrite body having slots corresponding to the connector pins and notches positioned between the slots and the edge, the notches being contiguous with the slots, the ferrite body being inserted within the second recess, the second ends of the connector pins protruding through the slots; and (b) chip capacitors inserted into the notches of the ferrite body, the capacitors being electrically connected between the edge and the connector pins.

The improved connector with built-in filter includes the following features:

(1) The inside of the shield case is not hermetically sealed after soldering of the filter element. This permits the flux to be washed away to maintain long-range reliability as a filter.

(2) Chip capacitors are inserted in notches within the ferrite, so that even when thermal expansion or contraction occurs between the shield case and the dielectric housing due to differences in thermal expansion coefficients, the chip capacitor is not subjected to stress directly. Thus, the chip capacitor can suitably be used during temperature cycle testing.

(3) The chip capacitors can be mounted adjacent to the connector pins, which allows the spacing between the connector pins to be reduced.

(4) The ferrite block is incorporated within the dielectric housing which (a reduces the number of manufacturing steps; and (b) allows miniaturization of the connector.

(5) A capacitor directly connects the grounded shield case and each pin, whereby the residual inductance generated at the ground-side of the connector is reduced to an extremely small value, which permits extremely efficient elimination of high-frequency noise.

(6) A ferrite block is inserted into the window of the shield case and the second recess, which has slots for allowing the connector pins to penetrate through the ferrite block. Therefore, an inductance component is generated in the connector pins, and the connector itself becomes electromagnetic shielding structure which is extremely effective in preventing high-frequency noise. Therefore, when the connector is mounted on the shielded device, the radiation noise generated inside the device or the radiation noise invading from the outside of the device can be completely shielded.

BRIEF DESCRIPTION OF THE DRAWINGS

The foregoing and other objects of the present invention as well as its operating advantages will be apparent from the description of the preferred embodiments with reference to the accompanying drawings in which.

DESCRIPTION OF THE PREFERRED EMBODIMENTS

Figure 1:
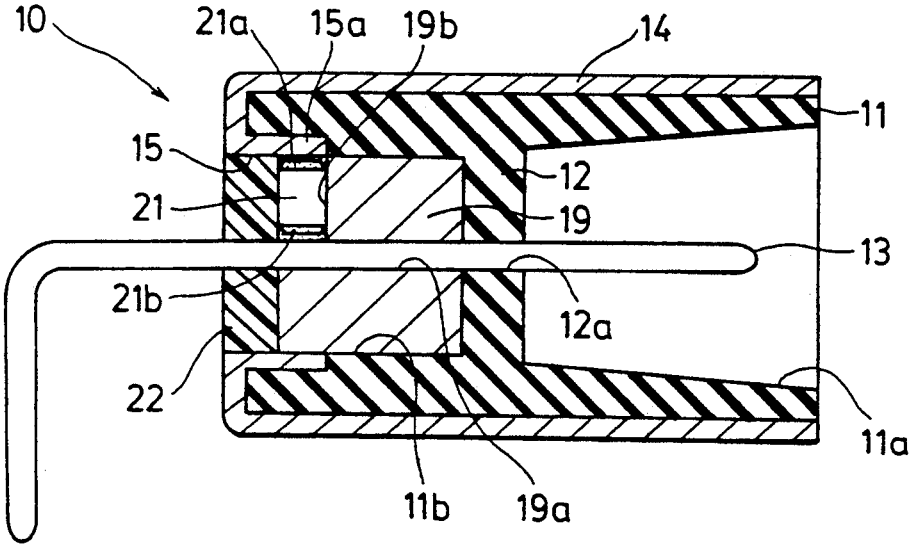
FIG. 1 is a sectional view of an embodiment of a connector with built-in filter according to the invention.
Figure 2:
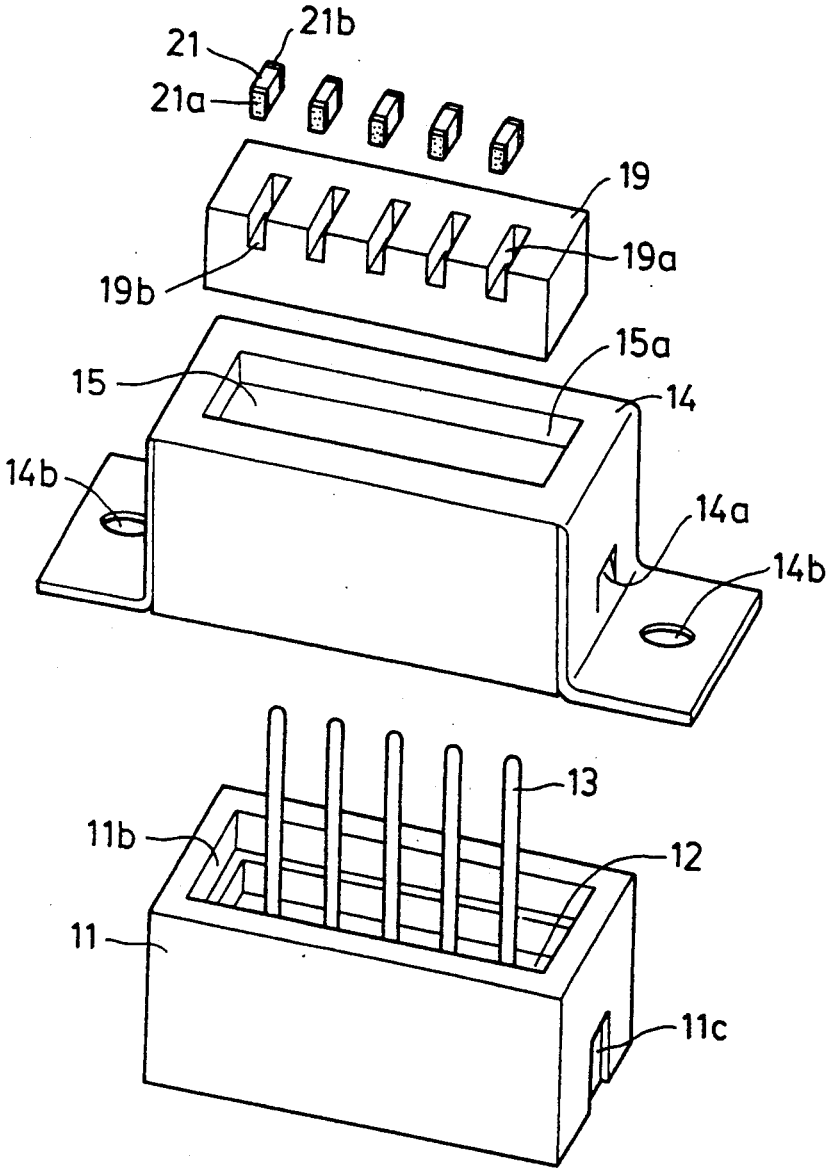
FIG. 2 is an exploded perspective view of FIG. 1.

As shown in FIGS. 1 and 2, a dielectric housing 11 of a connector with built-in filter 10 has a partitioning plate 12 which is unitary with the dielectric housing 11. A first recess 11*a* is provided on one side of the housing 11 and partitioning plate 12. A second recess 11*b* is provided on the opposite side of the housing 11 and partitioning plate 12. In this example, five through holes 12*a* are provided along the center of the partitioning plate 12 in a longitudinal direction of the housing 11. The through holes 12*a* are spaced at even intervals. Five connector pins 13 are fixed penetrating through the through holes 12*a*. The connector pins 13 are positioned within the first recess 11*a* and protrude through holes 12*a* into the second recess 11*b*. The end protruding into the second recess 11*b* is bent during a later process and results in the device shown in FIG. 1. The outer surface of the housing 11 is provided with a holding slot 11*c*.

A shield case 14 is formed by bending a plate of conductor in hat-shape. The shield case 14 is made of surface treated metal such as Fe-Sn alloy, Cu-Zn alloy (brass) and the like. The shield case 14 is provided on its top surface with a window 15 which corresponds to the opening of the second recess 11*b*, and an edge 15*a* of the window 15 is bent inwardly. A tapped hole 14*b* for mounting the shield case is provided. The shield case 14 is fixed on the housing 11 so that the connector pins 13 protruding through the second recess 11*b* exit through the window 15. Holding slots 11*c* in the housing 11 engage pawls 14*a* which are formed on the side of the shield case 14 to secure the shield case 14 to the housing 11.

A ferrite block 19 is then inserted within the second recess 11*b*. The block 19 having five holes 19*a* which allow the five connector pins 13 to protrude through the block. Five notches 19*b* are provided contiguously to each of the holes 19a. The ferrite block 19 is secured within the second recess 11b. The ferrite block may be secured in the second recess by an adhesive or sealing agent. A chip capacitor 21 is inserted into each of the notches 19b. The chip capacitors 21 may also be inserted into the notches 19b before the ferrite block 19 is inserted into and secured within recess 11b. If the width of the connector pins at the notches 19b is formed corresponding to the thickness of each capacitor 21, the spacing interval between each of the connector pins can be reduced considerably.

One terminal electrode 21a of each chip capacitor 21 is connected to the window edge 15a of the shield case 14 and the other terminal electrode 21b is connected to each connector pin 13 respectively by soldering, etc. The exposed surfaces of the chip capacitors 21 and ferrite block 19 are sealed using a sealing agent 22 to prevent moisture and dust from entering the window 15 and related areas. Synthetic resin of epoxy or silicone series is used as a sealing agent 22. After sealing, the ends of the connector pins 13 which protrude through the sealant are bent substantially at a right angle to permit insertion of the connector into the printed circuit board of electronics devices (not shown). The pins may be inserted into an appropriate cooperating funnel connector of the electronics device.

Figure 3:
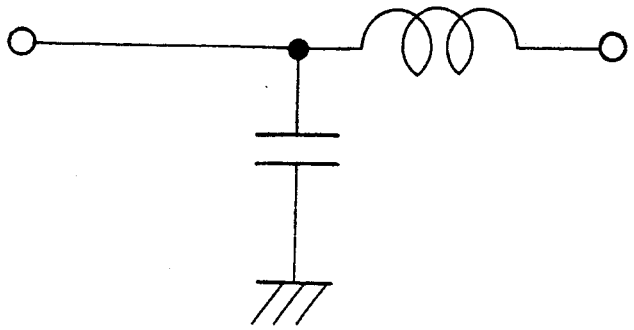
FIG. 3 is an equivalent circuit of the connector with built-in filter.

The connector with built-in filter 10 having the construction described above constitutes an equivalent circuit in which an inductor and a capacitor are combined as shown in FIG. 3. By mounting the shield case 14 on the electronics devices (not shown) by screwing screws into the tapped holes 14b of the shield case 14 to effect a grounding of the connector, terminal electrode 21a of each chip capacitor 21 is directly connected to the casing of the device. Accordingly, the residual inductance generated at the ground-side of the connector, after the completion of the mounting on the electronics devices, is reduced to an extremely small value. Therefore, high-frequency noise is securely eliminated.

Figure 4:
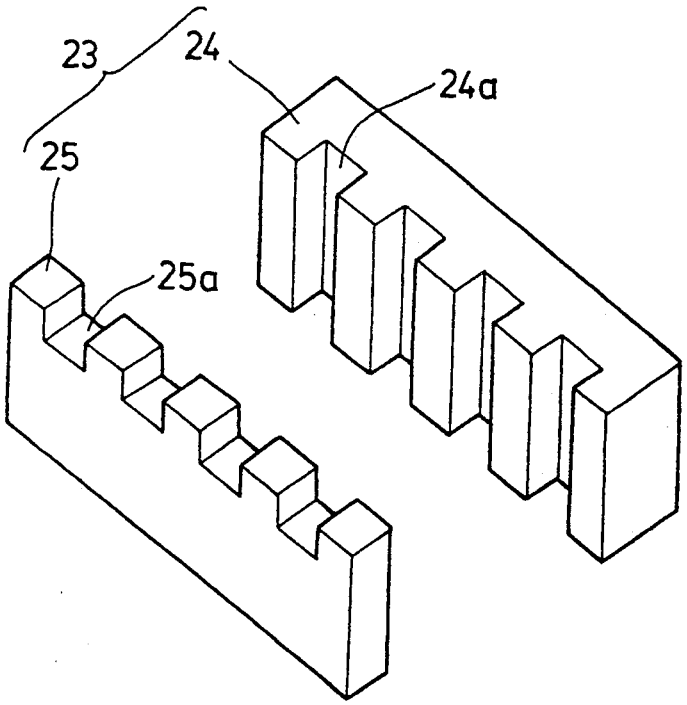
FIG. 4 is an exploded perspective view of a ferrite block.

A unitary body was used for the ferrite block 19 in the example described above, however, a ferrite block 23 of combination type including first block 24 and second block 25 may be used as shown in FIG. 4. The side-surface of the first block 24 is formed with four slots 24a for inserting the connector pins. At the top surface of the second block 25 is formed four notches 25a for inserting the chip capacitors so that they engage the pins when inserted through the slots 24a. The first block 24 and the second block 25 are integrated together and fixedly inserted within the second recess 11b of the housing 11.

Figure 5:
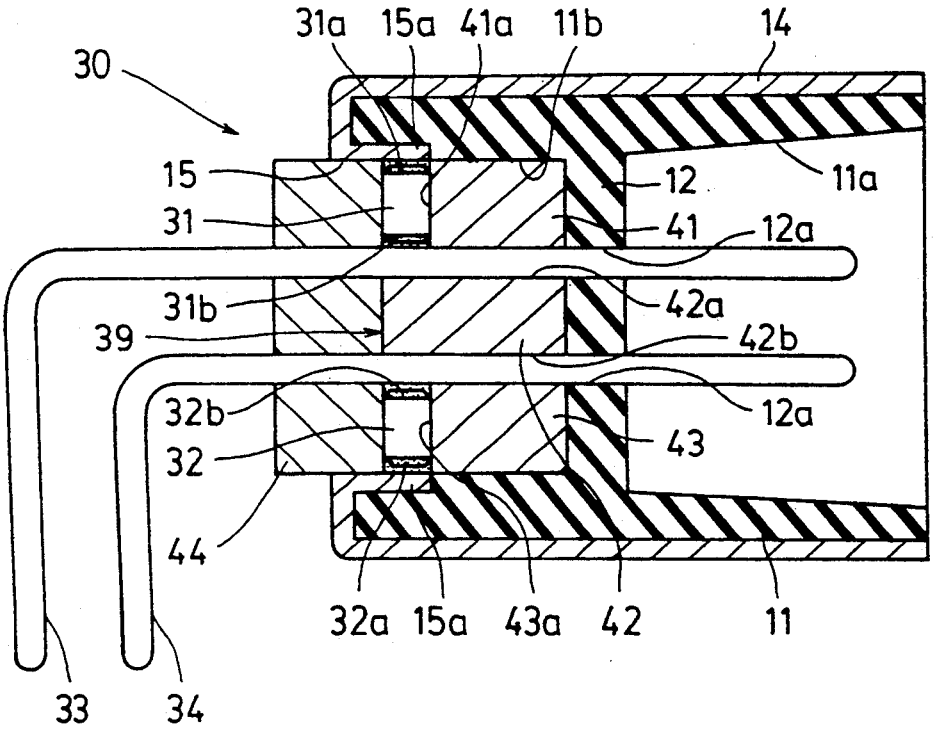
FIG. 5 is a sectional view of a second embodiment of a connector with built-in filter according to the invention.
Figure 6:
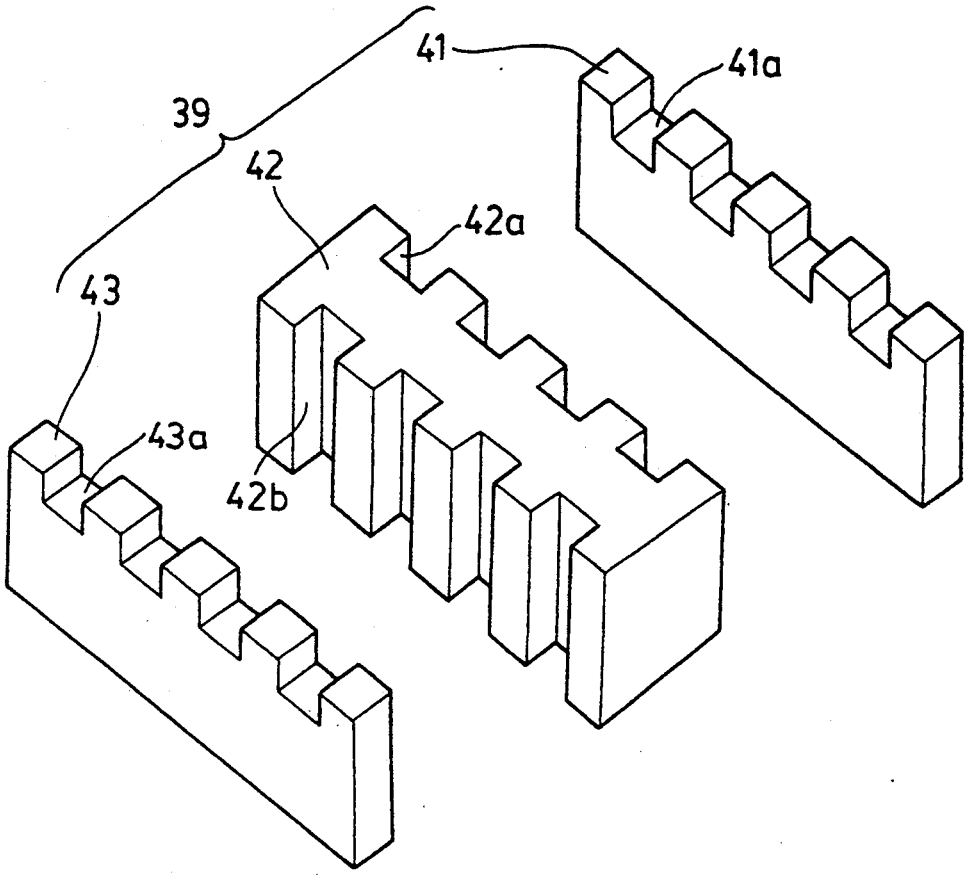
FIG. 6 is an exploded perspective view of the ferrite block in FIG. 5.

FIGS. 5 to 8 show a connector with built-in filter 30 of another embodiment according to the invention. In FIG. 5, the same reference numerals in FIG. 1 show similar constituent elements. In this example, eight connector pins 33 (4 pins) and 34 (4 pins), penetrate and are fixed to the partitioning plate 12 of the dielectric housing 11. As shown in FIG. 6, a ferrite block 39 is composed of two side portions 41 and 43 and a central portion 42. Both side surfaces of the block 42 are formed with four sets of slots 42a and 42b for inserting the connector pins. Top surfaces of the side blocks 41 and 43 are each formed with four notches 41a and 43a respectively, which correspond to the slots 42a and 42b, respectively. Slots 41a and 43a receive the chip capacitors 31 and 32, respectively.

Figure 7:
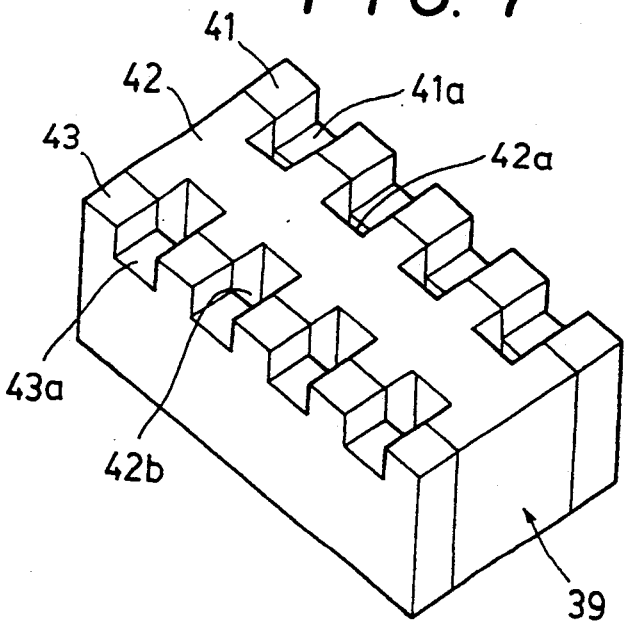
FIG. 7 is a perspective view of the combined ferrite block in FIG. 6.

As shown in FIGS. 5 and 7, the blocks 41 to 43 are integrated together to be inserted and secured within the second recess 11b of the housing 11. The notches 41a and 43a receive chip capacitors 31 and 32, respectively. Terminal electrode 31a of chip capacitor 31 is connected to the window edge 15a of the shield case 14, and terminal electrode 31b thereof is connected to the connector pin 33 by means of soldering, etc. Terminal electrode 32a of chip capacitor 32 is connected to the window edge 15a of the shield case 14, and terminal electrode 32b thereof is connected to the connector pin 34 by means of soldering, etc. The exposed surfaces of the chip capacitors 31 and 32 and the ferrite block 39 are covered with and adhered to a ferrite core 44. The pins 33 and 34 protrude through the core 44 and are attached thereto. Pins 33 and 34 are bent substantially in a right angle as required.

Figure 8:
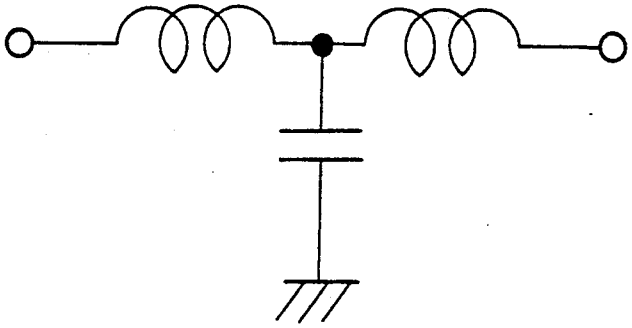
FIG. 8 is an equivalent circuit of the connector with built-in filter in FIG. 5.

The connector with built-in filter 30 having the foregoing structure constitutes an equivalent circuit of a T type low-pass filter as shown in FIG. 8, and exhibits a high grade characteristic with a compact size, even when it is provided with a number of connector pins.

The configurations of the ferrite blocks 19, 23 and 39, the number of the connector pins 13, 33 and 34, the respective number and arrangement of holes 19a, and slots 24a, 42a and 42b, and the respective number and arrangement of notches 19b, 25a, 41a and 43a are not limited to the foregoing example, however, they may preferably be modified and changed depending on requirements. The ferrite blocks 23 and 39 may be formed as a unitary body instead of being separate elements.

Figure 9:
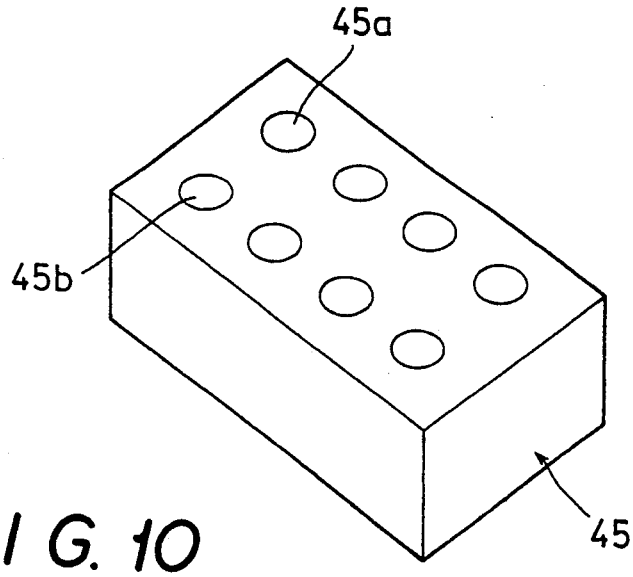
FIG. 9 is a perspective view of still another ferrite body.
Figure 10:
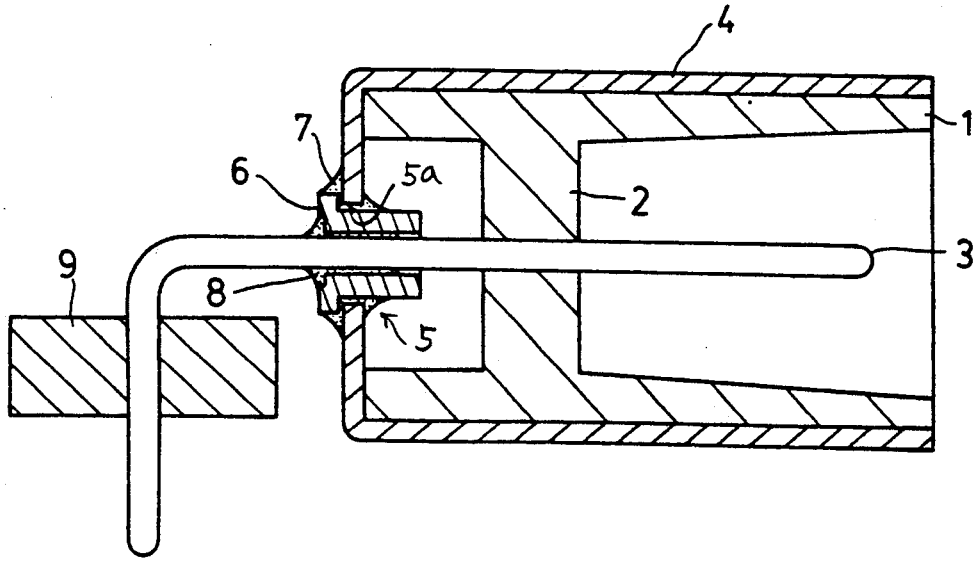
FIG. 10 PRIOR ART
FIG. 10 is a sectional view of a conventional connector with built-in filter.

The ferrite body to be inserted to the connector pins 33 and 34 after the completion of insertion of the chip capacitors is not limited to the ferrite core of the aforementioned embodiment, however, a ferrite block 45 or ferrite beads formed thereon with the holes 45a and 45b to which the connector pins 33 and 34, as shown in FIG. 9, are inserted may be employed.

While the foregoing description and drawings represent the preferred embodiments of the present invention, it will be obvious to those skilled in the art that various changes and modifications may be made therein without departing from the true spirit and scope of the present invention.

What is claimed is:

1. In a connector with a built-in filter having a dielectric housing, said housing having first and second ends, a first recess being formed at said first end and a second recess being formed at said second end, the first and second recesses having a partitioning plate therebetween; connector pins having first and second ends, said first end positioned within the first recess, said pins penetrating through holes provided within said partitioning plate, and said second end protruding through the second recess; a conductive shield case surrounding said housing, said case having a window which corresponds to said second recess, said case having an edge at said window, said case being positioned so that said connector pins can protrude from the window, the improvement comprising:

(a) a ferrite body having slots corresponding to said connector pins and notches positioned between the slots and said edge, the notches being contiguous with the slots, said ferrite body being inserted within the second recess, said second ends of said connector pins protruding through the slots; and (b) chip capacitors inserted into the notches of said ferrite body, said capacitors being electrically connected between said edge of said shield case and said connector pins.

2. The connector of claim 1, wherein said ferrite body comprises two ferrite portions, a first portion having slots corresponding to said connector pins and a second portion having notches for said chip capacitors, said two ferrite portions being juxtaposed to allow said pins to protrude from said body through said slots and to retain said chip capacitors between said first ferrite portion and said case edge.

3. The connector of claim 1 wherein a seal is inserted in said window to enclose the chip capacitors and ferrite body and to surround a portion of said pins.

4. The connector of claim 1 wherein said ferrite body is a first such body and a second ferrite body is included, said second ferrite body having slots corresponding to said connector pins, said second ferrite body being fixedly inserted within the window with said pins extended therethrough and protruding from said second ferrite body, said chip capacitors being sandwiched between said first and second ferrite body.

5. The connector of claim 4, wherein said second ferrite body is a ferrite core.

6. The connector of claim 4, wherein said second ferrite body is composed of the material of said first ferrite body.

7. The connector of claim 4 wherein said first ferrite body comprises a plurality of ferrite portions which are arranged to provide a plurality of rows of slots for connector pins and a plurality of rows of notches for chip capacitors.

* * * * *